United States Patent [19]

Ackermann

[11] 4,235,178

[45] Nov. 25, 1980

[54] BOBBIN THREAD TENSION DEVICE

[75] Inventor: Manfred Ackermann, Elmhurst, Ill.

[73] Assignee: Union Special Corporation, Chicago, Ill.

[21] Appl. No.: 23,573

[22] Filed: Mar. 26, 1979

[51] Int. Cl.[3] ..... D05B 57/26; B65H 59/06

[52] U.S. Cl. ..... 112/229

[58] Field of Search ..... 112/229, 233, 231; 242/156, 129.8, 156.1, 156.2, 75.4

[56] References Cited

U.S. PATENT DOCUMENTS

| | | | |
|---|---|---|---|
| 2,583,538 | 1/1952 | Bracklin | 112/231 |
| 2,836,136 | 5/1958 | Ayres | 112/229 |
| 3,381,642 | 5/1968 | Bono | 112/229 |
| 3,437,284 | 4/1969 | Philips | 112/229 |

FOREIGN PATENT DOCUMENTS

| | | | |
|---|---|---|---|
| 217806 | 5/1958 | Australia | 112/229 |
| 950529 | 10/1956 | Fed. Rep. of Germany | 112/229 |
| 435947 | 11/1967 | Switzerland | 112/229 |
| 595496 | 2/1978 | Switzerland | 112/233 |

*Primary Examiner*—Werner H. Schroeder
*Assistant Examiner*—Andrew M. Falik
*Attorney, Agent, or Firm*—John A. Schaerli; J. Arthur Swanson

[57] ABSTRACT

A bobbin thread tension for a closed end cylindrical body bobbin thread case of a horizontal axis type rotary hook for a lockstitch sewing machine consisting of a diagonally slotted thread aperture in the wall of the bobbin case partially covered by a bobbin thread control that is adjustably mounted on the wall of the bobbin case by a pivot screw at one of its ends and inward a clamp screw passing through an enlarged hole in the bobbin thread control allowing the control to be pivoted to cover an effective amount of the thread aperture thereby increasing or decreasing the bobbin thread tension.

5 Claims, 3 Drawing Figures

BOBBIN THREAD TENSION DEVICE

This invention relates to a bobbin thread tensioning means for sewing machine bobbin cases when using heavy thread such as sizes 99, 138 and 207 nylon.

BACKGROUND OF THE INVENTION

Sewing machines of the lockstitch type conventionally employ a rotary hook disposed beneath the bed of the machine for cooperation with the needle when the latter penetrates the material and passes through the needle opening in the throat plate of the bed. In such machines the rotary hook carries a thread bobbin which supplies the thread for interengagement with the thread carried by the needle. The thread bobbin is enclosed in a bobbin case, removably supported upon the center pin or stud of the bobbin case holder and retained in place by a latching means.

Bobbin cases of the type mentioned above also conventionally employ a thread tensioning means for applying a frictional force or tension upon the thread coming from the bobbin. Where a latching means, as mentioned above, is utilized upon the bobbin case, the tensioning means ordinarily is provided upon the side wall of the case. The tension means is normally a spring secured by a screw to the side wall of the bobbin case to which the tension can be adjusted by means of an adjusting screw. The bobbin thread extends between the outside of the side wall of the bobbin case and the underside of the tension spring. As the adjusting screw is tightened, more pressure is exerted on the thread. This tension means is very effective on small size threads. But when using large size threads, such as size 99, 138 and 207 nylon its effectiveness decreases. A somewhat light tension can be held, but when tightening the adjusting screw, the tension increases, but is very erratic, that is not uniform. This results in the making of an unbalanced stitch, namely bobbin thread being pulled up to be seen from the top or needle thread loops hanging down from the underside.

SUMMARY OF THE INVENTION

The invention under consideration is a bobbin thread tension means to be employed primarily when using a heavy bobbin thread. The function is such that the tension control, which is adjustable, covers a slotted thread aperture in the bobbin case. The tension regulator is used to enlarge the thread aperture in the bobbin case for less bobbin thread tension, and to decrease the thread aperture in the bobbin case for more bobbin thread tension. The tension control is mounted on the side wall on the bobbin case.

The tension control is pivotally secured at one end by a pivot screw and has a clamp screw inward from this end which fits through an enlarged hole and threads into the bobbin case. The other end of the tension regulator has a somewhat pointed end which passes over the slotted bobbin thread aperture. By loosening the clamp screw, the tension control can be pivoted so that its pointed end will cover more or less of the bobbin thread aperture.

It is therefore an object of this invention to provide a bobbin thread control means for use with heavy bobbin thread that is easily adjusted to vary the bobbin thread tension.

Another object of the invention is to provide a bobbin thread control means for use with heavy bobbin thread that will provide a uniform tension whether it be light or heavy.

With the above objects, features and advantages of the invention in mind, an illustrative embodiment of the same will now be described in some detail in relation to the accompanying drawings in which.

Figure 3:
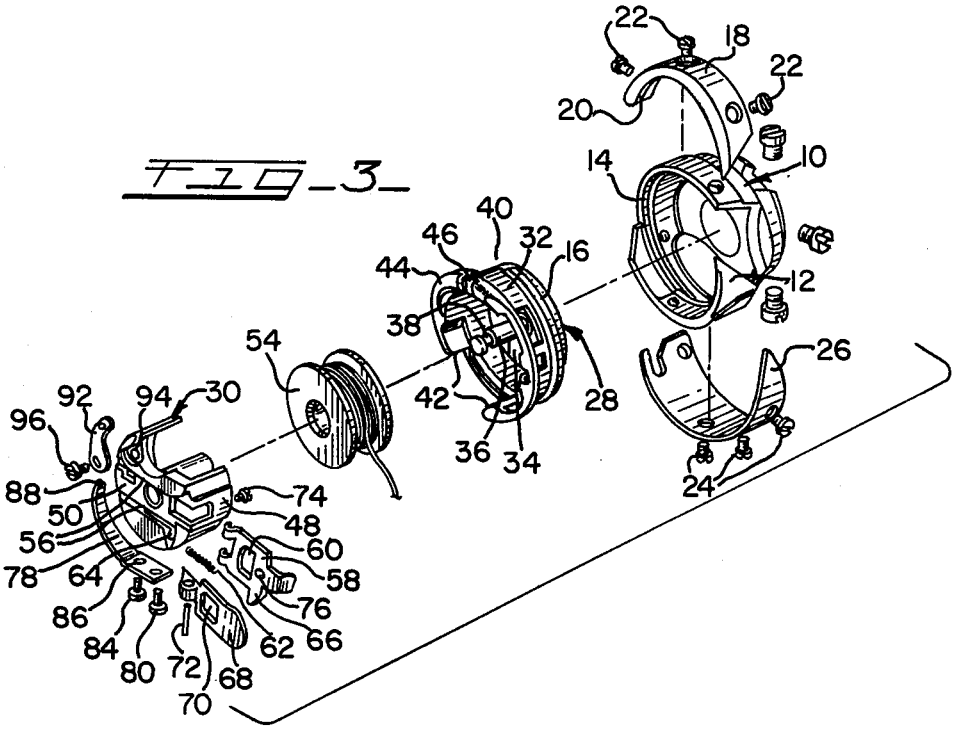
FIG. 3 is an exploded view of a rotary hook assembly containing a bobbin case incorporating the invention.

Referring now to the drawings and more particularly to FIG. 3, the rotary hook assembly to which the bobbin thread control means of this invention is applied includes rotating parts and stationary parts. The rotating parts comprise a generally cup shaped member 10 having a cutout at which is defined a hook point or beak 12. A raceway 14 is provided on the inner surface of cup shaped member or hook base 10 for carrying the bobbin case holder rail 16. Detachable retainer 18 containing an overhanging lip 20 is secured to the outside of the hook base by a number of screws 22 to contain the rail 16 within the raceway 14. Also mounted on the outside of the hook base by means of screws 24 is a plate 26 having one of its ends adjacent to the hook point 12.

Figure 1:
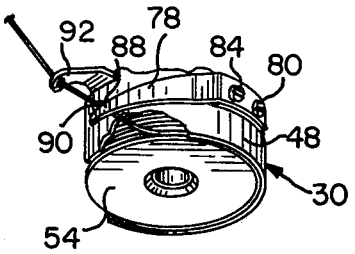
FIG. 1 is an isometric view of a bobbin case incorporating the invention.
Figure 2:
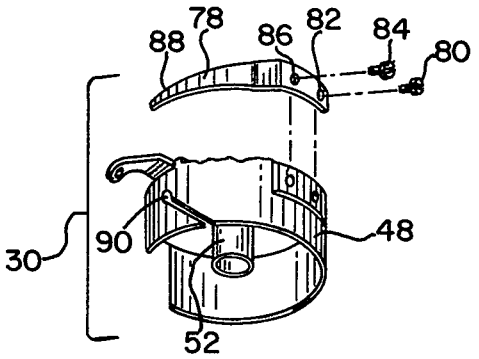
FIG. 2 is an exploded view of a bobbin case incorporating the invention.

The stationary parts of the rotary hook comprise a bobbin case holder 28 and a bobbin case 30 shown also in FIGS. 1 and 2.

The bobbin case holder or basket 28 is formed with a cup like body member 32 provided at the bottom and inner end with a crossbar 34 arranged to support an axially disposed center pin 36. Pin 36 has an annular notch 38 adjacent to its rounded outer end. Bobbin case basket rail 16 is formed as an annular rib on the outer surface of body member 32 having a gap 40. The rail 16 is journaled in the hook raceway 14 of the rotating member of the rotary hook. Body member 32 has a cutout 42 extending along approximately one quarter of the circumference and extending down to the rail 16. A radially extending flange 44 is formed at the outer end of the bobbin case body member 32. Flange 44 is provided with a retaining notch 46 adapted to mate with a lug mounted on a bobbin case retainer finger (not shown) to prevent the bobbin case and bobbin case holder from rotating with the rotary components of the hook during operation of the machine.

Bobbin case 30 shown separately in FIGS. 1 and 2 and also in exploded FIG. 3 comprises a substantially closed cylindrical body member or circular shell 48 having a closed outer end 50 from which projects a tubular axial post 52 which is adapted to fit on pin 36 of the bobbin case holder. The axial post 52 carries the bobbin 54 as shown in FIG. 1. Closed outer end 50 of body member 48 is provided with a pair of parallel undercut guide ribs 56 to which are fitted opposite edges of a spring loaded latch 58. Latch 58 is provided with an aperture 60, one end which is adapted to mate with notch 38 of pin 36 of bobbin case basket 28 thereby to hold the bobbin case 30 within the bobbin case basket 28. Bobbin case latch spring 62 fits into hole 64 located adjacent to lower undercut guide rib 56 and presses against lug 66 of latch 58. Bobbin case latch lever 68, having an aperture 70, is pivotally mounted at one end thereof on one end of latch 58 by means of hinge pin 72 such that when lever 68 is rotated away from latch 58, the latch is disengaged from notch 38 of pin 36, permitting removal of the bobbin case from the bobbin case holder. Screw 74 is threaded into hole 76 of latch 58 from the underside of the latch. Screw 74 prevents the latch 58 and latch lever 68 from being inadvertently removed from the bobbin case 30.

Flat bobbin thread tension leaf spring control 78 is pivotally secured at one end by screw 80 that passes through first hole 82 in control 78 and then threads into the outside wall of the bobbin case 30 as shown in FIGS. 1 and 2. Inward from this end clamp screw 84 fits through enlarged hole 86 and threads into the bobbin case 30. The free end 88 of control 78, tapered to a round end, partially covers a diagonally slotted thread aperture 90 in the side of the bobbin case 30. The enlarged hole 86 of control regulator 78 allows the control 78 to be pivoted or laterally displaced so that its free end 88 will cover more or less of the bobbin thread aperture 90.

Control 78 has a radius of curvature of slightly less than the radius of curvature of the cylindrical body of the bobbin case 30 enabling the free end 88 to hug the side wall of the bobbin case, preventing the bobbin thread from sliding out from between the underside of the free end and the outer wall of the bobbin case. Bobbin case 30 is provided with eyelet 92 that is mounted on a recessed portion 94 of closed end 50 by means of screw 96. Eyelet 92 is positioned to effectively guide the bobbin thread up to the needle hole in the throat plate (neither shown).

A bobbin thead tension adjustment means for a closed end cylindrical body bobbin case of a rotary hook for a lockstitch sewing machine has been provided having a slotted thread aperture covered by the free end of a bobbin thread tension control that is adjustably mounted on the wall of the bobbin case allowing the regulator to be pivoted to cover more or less of the aperture thereby increasing or decreasing the bobbin thread tension.

Having thus described the invention, what is claimed herein is:

1. A bobbin thread case means having an apertured circular shell which permits the passage of thread therethrough and a bobbin thread tension means arranged on the other surface of said shell comprising:

a pivotally mounted bobbin thread control means the free end of which is laterally displaceable relative to the aperture in said shell through which the thread passes, the free end of said control means being pivotally movable in a path extending substantially parallel to the circular shell and adapted to selectively regulate the size of said thread aperture whereby varying the bobbin thread tension.

2. The bobbin thread tension means of claim 1 wherein:

the free end of said bobbin thread control means is tapered to a round end with one edge of taper cooperating with said thread aperture.

3. A bobbin thread tension means for a rotary hook of a Lockstitch sewing machine having a bobbin thread case means including a substantially closed cylindrical body means with a closed outer end, said cylindrical body means having an aperture means for the passage of thread therethrough, said bobbin thread tension means comprising:

a bobbin thread control means cooperating with said thread aperture, said bobbin thread control means includes a first hole means arranged at one end of said control means and an enlarged second hole means located inward from said first hole means, a pivot screw passing through said first hole means in said control means and threaded into said cylindrical body means, and a clamp screw passing through said enlarged second hole means in said control means and threaded into said cylindrical body means, said bobbin thread control means being adjustably mounted for pivotal movement about said aperture in a plane substantially parallel to said cylindrical body means for regulating the size of said thread aperture thus increasing or decreasing bobbin thread tension.

4. The bobbin thread tension means of claim 1 wherein:

said bobbin thread control means has a radius of curvature of slightly less than the radius of curvature of said cylindrical body means.

5. A bobbin thread tension means for a rotary hook of a lockstitch type sewing machine having a bobbin thread case means including a substantially closed cylindrical body means with a closed outer end, said cylindrical body means having a diagonally slotted aperture means for the passage of thread therethrough, said bobbin thread tension means comprising:

a bobbin thread leaf spring control means having a first extremity tapering to a round end with one edge of said taper cooperating with said thread aperture, a first hole at a second extremity and an enlarged second hole inward from said first hole, a pivot screw passing through said first hole in said control means and threaded into said cylindrical body means, and a clamp screw passing through said enlarged second hole in said control means and threaded into said cylindrical body means, said control means being adjustably mounted for pivotal movement in a plane substantially parallel to said cylindrical body to permit movement of said tapered edge relative to said thread aperture whereby controlling the size of said thread aperture thus regulating the bobbin thread tension.

* * * * *